US005465535A

United States Patent [19]

Skogberg

[11] Patent Number: 5,465,535

[45] Date of Patent: Nov. 14, 1995

[54] METHOD OF INSTALLING A SOIL ANCHOR AND A SOIL ANCHOR

[75] Inventor: Bo T. Skogberg, Haninge, Sweden

[73] Assignee: Soilex AB, Stockholm, Sweden

[21] Appl. No.: 176,167

[22] Filed: Dec. 30, 1993

Related U.S. Application Data

[63] Continuation-in-part of PCT/SE92/00508, Jul. 1, 1992.

[30] Foreign Application Priority Data

Jul. 1, 1991 [SE] Sweden ..... 9102054

[51] Int. Cl.[6] ..... E02D 5/74; E02D 5/54

[52] U.S. Cl. ..... 52/156; 52/2.11; 52/155; 405/232; 405/244

[58] Field of Search ..... 52/155, 156, 2.11; 405/232, 244, 253, 259.5, 302.2

[56] References Cited

U.S. PATENT DOCUMENTS

| | | | |
|---|---|---|---|
| 1,101,364 | 6/1914 | Wallett | 403/253 X |
| 3,270,469 | 9/1966 | Debiton | 52/155 |
| 3,371,494 | 3/1968 | Lagerström | 52/155 |
| 3,377,807 | 4/1968 | Nave | 52/155 |
| 3,436,923 | 4/1969 | Lagerström | 52/156 |
| 3,738,071 | 6/1973 | Finsterwalder | 52/155 |
| 3,757,528 | 9/1973 | Finsterwalder et al. | 52/155 X |
| 4,000,623 | 1/1977 | Meardi . | |
| 4,060,994 | 12/1977 | Chitis | 52/155 X |
| 4,096,673 | 6/1978 | Deike | 52/156 |
| 4,487,528 | 12/1984 | Skogberg | 405/244 X |
| 4,571,126 | 2/1986 | Granström et al. | 405/244 |
| 4,661,021 | 4/1987 | Granström et al. | 405/244 |

FOREIGN PATENT DOCUMENTS

| | | | |
|---|---|---|---|
| 0079875 | 5/1983 | European Pat. Off. . | |
| 0112316 | 6/1984 | European Pat. Off. . | |
| 1294921 | 3/1987 | U.S.S.R. | 405/244 |
| 9106713 | 5/1991 | WIPO . | |
| 9301360 | 1/1993 | WIPO . | |

OTHER PUBLICATIONS

*Soilex Anchors, Permanent and Temporary Soil Anchors,* no publication date.

*Primary Examiner*—Carl D. Friedman
*Assistant Examiner*—Kevin D. Wilkens
*Attorney, Agent, or Firm*—Nils H. Ljungman & Associates

[57] ABSTRACT

A soil anchor and a method of installing a soil anchor, the soil anchor having: an expandable anchor body; a device for piercing and parting soil at the front end of the soil anchor; a device for transmitting force from a location remote from the soil anchor to the anchor body; a device for transporting hardenable material from a location remote from the soil anchor into the expandable anchor body to wedge the anchor body into the soil; and a device for leading at least one cable to avoid contact between at least one cable and the hardenable material, and for permitting movement of at least one cable adjacent the anchor body while the hardenable material is hardening or hardened.

18 Claims, 6 Drawing Sheets

A–A

B–B

METHOD OF INSTALLING A SOIL ANCHOR AND A SOIL ANCHOR

CONTINUING APPLICATION DATA

This application is a Continuation-In-Part application of International Application No. PCT/SE92/00508, filed on Jul. 1, 1992, which claims priority from Swedish Patent Application No. 9102054, filed on Jul. 1, 1991. International Application No. PCT/SE92/00508 was pending as of the filing data of U.S. application Ser. No. 08/176,167 and the U.S. was an elected state in International Application No. PCT/SE92/00508.

BACKGROUND OF THE INVENTION

1. Field of the Invention

The present invention relates to a method of installing a soil anchor by driving down an expansible anchor body of folded metal sheet into the ground by means of a rod or tube and then pressurizing the body to develop or spread the folds and expand the body. The present invention also relates to an anchor body.

2. Background Information

An anchor body and a method of the kind described above are described in EP 0112316-A. In practice, a tube can be used for driving down the anchor body, and then the tube can be used for injecting cement grout into the anchor body to expand the body. One or more reinforcing rods or stiff steel ropes or the like can be forced down through the tube and into the anchor body. The reinforcing rods can then be Used to take the tension load.

It can be, however, a disadvantage that the anchor typically cannot be used until the cement grout has hardened, which can take days or even a week. It can also sometimes be a disadvantage that the tube with its tension load carrying elements, such as reinforcing rods or stiff steel ropes, will remain in the soil and usually cannot be dug up without first being cut into pieces.

OBJECT OF THE INVENTION

It is an object of the present invention to make an anchor of this kind less costly and to make possible the use of an anchor almost immediately after installation. It is also an object to make it possible to take up or remove the anchor, except for the anchor body, fast and easily.

SUMMARY OF THE INVENTION

The present invention improves on the characteristics of typical anchors used in the past, preferably by making it possible to tension and use the anchor almost immediately after installation. Another possible advantageous feature of the present invention can be that the tensioning lines or cables can be removed from the anchor assembly, particularly in the case of temporary anchors, without having to first break the anchor apart.

The present invention can include an expansible anchor body, preferably constructed of steel. The anchor body is preferably bellowed or folded to allow for eventual expansion of the anchor body. Two cups are preferably located on the front and rear ends of the anchor body, and these cups are preferably connected to one another by a number of flats. A preferably steel block can be welded to the rear cup preferably located at rear end of the anchor body. The block can have a blind bore that for example, can be used for the insertion of a drill extension rod, or other similar device. The block can also have a second bore with a fitting for the insertion of a hose. The second bore can preferably extend or lead into the interior of the anchor body, preferably for the purpose of creating a passageway for cement grout, or other hardenable material.

The front end of the anchor body can have a part of a pulley 22 with a number of grooves for guiding the tension lines. A bow-formed plate can also be included to protect the part of the pulley.

The above-described anchor can be installed by threading the tension lines through the part of the pulley. A drilling machine, hydraulic hammer, or other similar machine, can then be used to force the anchor body into the ground. If a drilling rod is used, the drilling rod can be inserted into the blind bore of the steel block. A hose can also be inserted into the second bore of the steel block, so that the anchor body will preferably carry the hose and tension lines into the ground. Once the anchor body has reached a desirable depth, if a drilling rod was used, the drilling rod can then preferably be removed and hardenable material can then be pumped into the anchor body through the hose. Once the anchor body is filled, the tension lines will preferably be forced outward by the expansion of the anchor body. The ends of the tension lines can then preferably be coupled or joined and tension can essentially be loaded almost immediately after installation of the anchor. The anchor can be tensioned relatively soon after installation, preferably due to the fact that the tension lines are not in contact with the hardenable substance. Since the tension lines preferably surround the outside of the anchor body, the tension lines can be easily removed by pulling after the anchor is no longer needed.

In summary, one aspect of the invention resides broadly in a soil anchor for anchoring a structure into soil, the soil anchor comprising: an expandable anchor body configured for expanding and pressing against soil to wedge the soil anchor into soil; a front end; the front end comprising: means for piercing and parting soil to permit the expandable anchor body to be driven into soil; means for transmitting force from a location remote from the expandable anchor body to the expandable anchor body to drive the means for piercing and parting soil into soil; the means for piercing and parting soil being connected to the expandable body to transport the expandable body into the soil; means for transporting hardenable material from a location remote from the soil anchor into the expandable anchor body to expand the expandable anchor body and wedge the expandable anchor body into soil; and means for leading at least one cable, the means for leading at least one cable being configured for substantially preventing contact between at least one cable and the hardenable material while the hardenable material is hardening or hardened, and for permitting movement of at least one cable adjacent the expandable anchor body while the hardenable material is hardening or hardened.

Another aspect of the invention resides broadly in a method of anchoring a structure into soil including a soil anchor, the soil anchor comprising: an expandable anchor body configured for expanding and pressing against soil to wedge the soil anchor into soil; a front end; the front end comprising: means for piercing and parting soil to permit the expandable anchor body to be driven into soil; means for transmitting force from a location remote from the expandable anchor body to the expandable anchor body to drive the means for piercing and parting soil into soil; the means for piercing and parting soil being connected to the expandable body to transport the expandable body into soil; means for transporting hardenable material from a location remote from the soil anchor into the expandable anchor body to expand the expandable anchor body and wedge said expandable anchor body into soil; and means for leading at least one cable, the means for leading at least one cable being configured for substantially preventing contact between at least one cable and the hardenable material while the hardenable material is hardening or hardened, and for permitting movement of at least one cable adjacent the expandable anchor body while the hardenable material is hardening or hardened; said method comprising the steps of: providing means for piercing and parting soil to permit the expandable anchor body to be driven into the soil; providing means for transmitting force from a location remote from the expandable anchor body to the expandable anchor body to drive the means for piercing and parting soil into soil; providing means for leading at least one cable adjacent the expandable anchor body; leading at least one cable adjacent the expandable anchor body; transmitting force to drive the means for piercing and parting soil, the expandable anchor body, and at least one cable into soil; providing a means for transporting hardenable material from a location remote from the soil anchor into the expandable anchor body to expand the expandable anchor body and wedge the expandable anchor body into soil; transporting hardenable material into the expandable anchor body to expand the expandable anchor body; and removing at least one cable by pulling when the soil anchor is no longer needed.

BRIEF DESCRIPTION OF THE DRAWINGS

The invention will be described with reference to the drawings in which.

DESCRIPTION OF THE PREFERRED EMBODIMENTS

Figure 1:
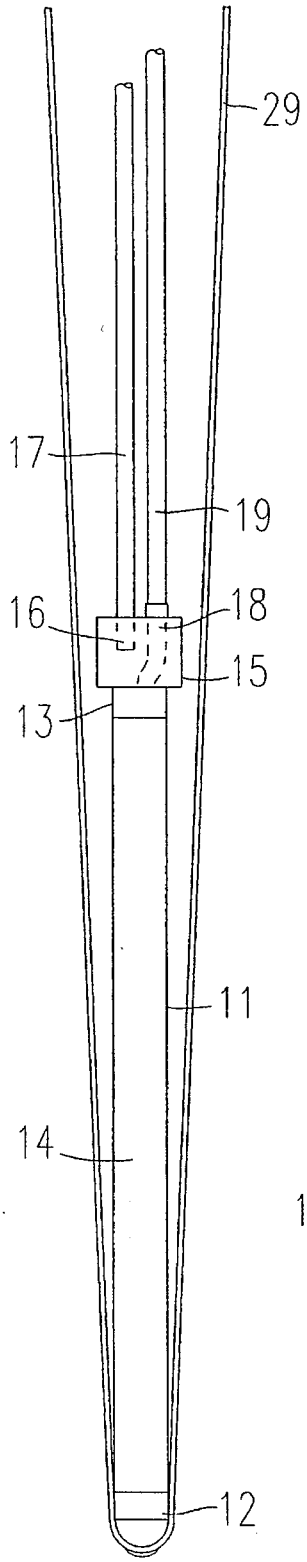
FIG. 1 shows an anchor configuration during insertion into the soil.
Figure 2:
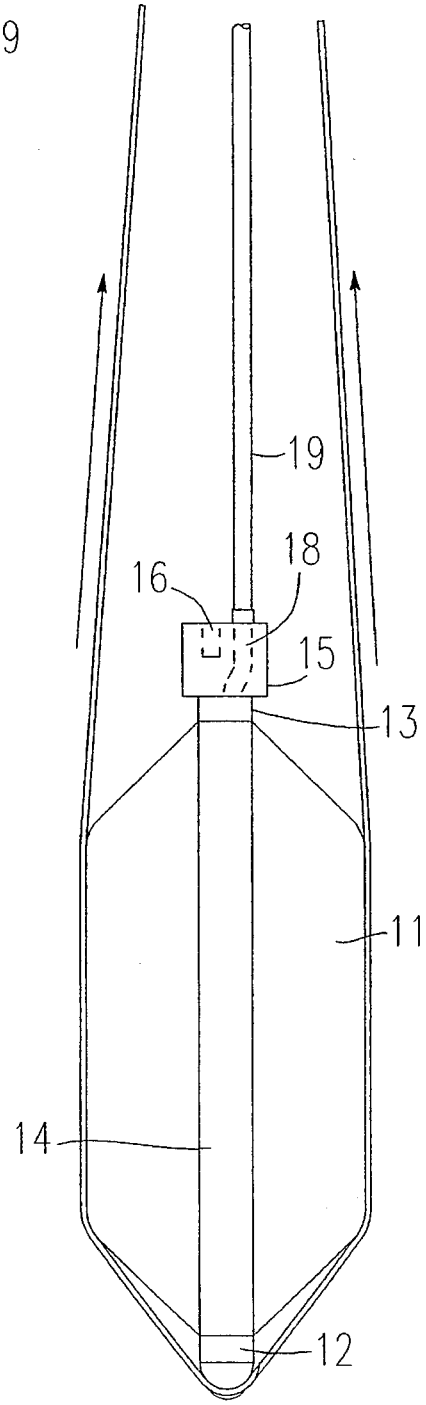
FIG. 2 shows the same anchor as shown in FIG. 1 with the anchor body in an expanded state.
Figure 3:
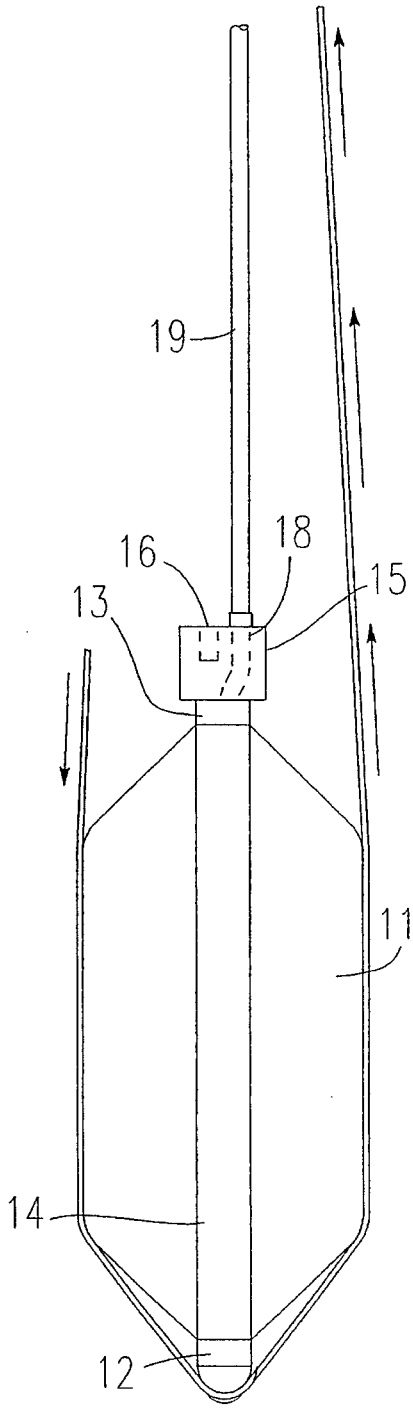
FIG. 3 shows the same anchor as shown in FIG. 1, but shows the anchor while being disassembled.

In FIGS. 1–3, an expansible anchor body 11 is shown. It is generally of the kind described in EP-0112316-A, and therefore will not be described in detail herein. However, EP-0112316-A is hereby incorporated by way of reference for background material regarding the structure of the anchor body 11. The anchor body 11 can preferably be made of two steel sheets that can preferably be welded together along their longitudinal edges and preferably folded in a zig zag form. The welded sheets then can preferably form a cylindrical pole with a rectangular or square cross-section, as shown in FIG. 1. A cup 12 preferably covers and seals the front end of the pole and an annular cup 13 preferably surrounds the rear upper end of the pole. In accordance with a preferred embodiment, the annular cup 13 can be embodied by a ring. For flats 14 can preferably be welded to the cups 12,13. There can preferably be a sealing viscous agent, for example asphalt, in the cups 12,13. The cups 12,13 can preferably be held together or connected by the flats 14. In accordance with a preferred embodiment, the flats 14 can be embodied by metal plates. A preferably solid steel block 15 can preferably be welded to the rear cup 13. The block 15 can preferably have a blind bore 16, preferably for insertion of the end of a rock drill extension rod 17. The block 15 can also preferably have a bore 18 with a fitting for a hose 19. The bore 18 preferably ends near the center of the annular cup 13. That is, the bore 18 can preferably be open and extend into the interior space of the folded steel sheets. When a pressure fluid, for example, cement grout or other hardenable material, is supplied preferably under pressure through the hose 19, the folded sheet metal body 11 can develop into a preferably circular cylinder with conical ends, as shown in FIG. 2. During the inflation of the anchor body 11, the flats 14 can preferably still hold the cups 12,13 in place.

Referring back to FIGS. 1–3, as discussed above, the anchor body 11 may be constructed by starting with two steel sheets. The sheets can then preferably be welded together along their longitudinal edges to form a tube-like structure. This tube-like structure can preferably then be folded, corrugated or creased, preferably to have a zig-zagged or bellowed shape. Alternatively, a single sheet may be used to form the anchor body 11. The longitudinal edges of the sheet could then be welded together as discussed above to form a tube-like structure. As also discussed above, this tube-like structure could then be folded to form a bellowed shape. The anchor body 11 is preferably folded or corrugated in order to permit the anchor body 11 to expand when filled with a hardenable substance. Thus, the anchor body 11 is preferably in a reduced or collapsed state when inserting the anchor body 11 into the ground or soil.

At the lower end of the anchor body 11, there can be disposed a cup 12. An additional cup 13 can preferably be disposed at the upper end of the anchor body 11, which cup 13 can be constructed to encircle the anchor body 11. The two cups 12 and 13 can be connected by the flats 14. The flats 14 may vary in shape and number. In one embodiment, the flats 14 can preferably be made of steel, or another material able to withstand a substantial amount of force due to the hammering of the anchor body 11 into the ground or soil. Further, in this embodiment, the flats 14 can preferably be disposed centrally inside the anchor body 11. The anchor body 11. The anchor body 11 can then preferably expand around the flats 14, with the flats 14 preferably still holding the cups 12 and 13 relatively stationary with respect to the anchor body 11.

The bore 18 can preferably extend into the cup 13, preferably creating a passageway into and through the anchor body 11. The hose 19 can then preferably be used to transport a hardenable material, such as cement grout, into the anchor body 11, in order to inflate the anchor body 11.

Figure 4:
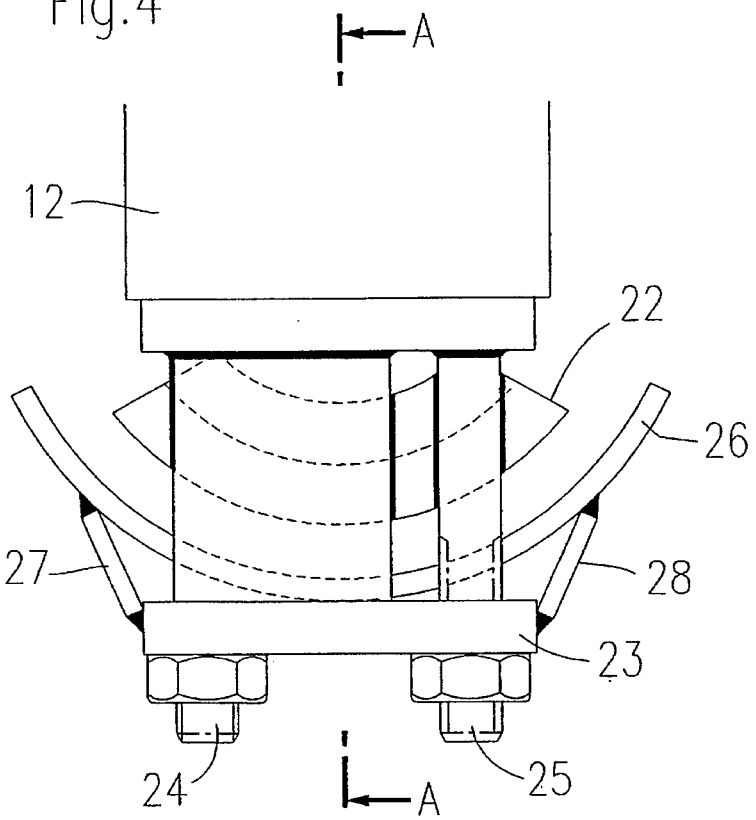
FIG. 4 shows the enlarged front end of the anchor shown in FIGS. 1–3 with its various components.

FIG. 4 shows the enlarged front end of the anchor body

11. A part of a pulley 22 can preferably be welded to the cup 12. The part of the pulley 22 preferably has three grooves 22*a* for guiding preferably three tension lines, such as steel ropes, cables, or strands. The part of the pulley 22 can preferably be protected by a steel plate 23. The steel plate 23 is preferably carried by two rigid bolts 24,25 that are also preferably welded d the cup 12. The plate 23 can be considered to represent means for piercing and parting soil. Further, the bolts 24, 25 are preferably disposed in opposite diagonal corners of the plate 23. A preferably bow-formed plate 26 can be supported by support plates 27,28. The support plates 27,28 can preferably be welded to the plates 23,26. In FIGS. 1–3, one of preferably three parallel steel ropes 29 can be seen. Such steel ropes 29 are preferably deviated over the bow-formed support or the part of the pulley 22, and can preferably be guided by grooves 22*a*. The grooves 22*a* are preferably disposed on the underside of the part of the pulley 22.

Figure 5:
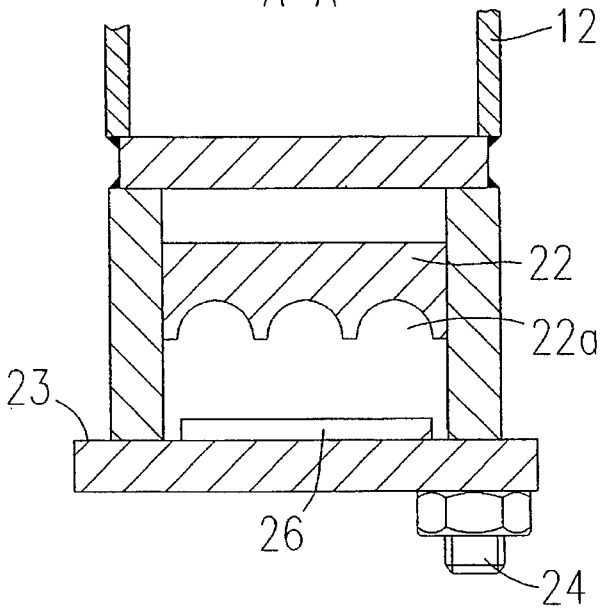
FIG. 5 shows a cross-section along he lines A—A in FIG. 4.
Figure 4A:
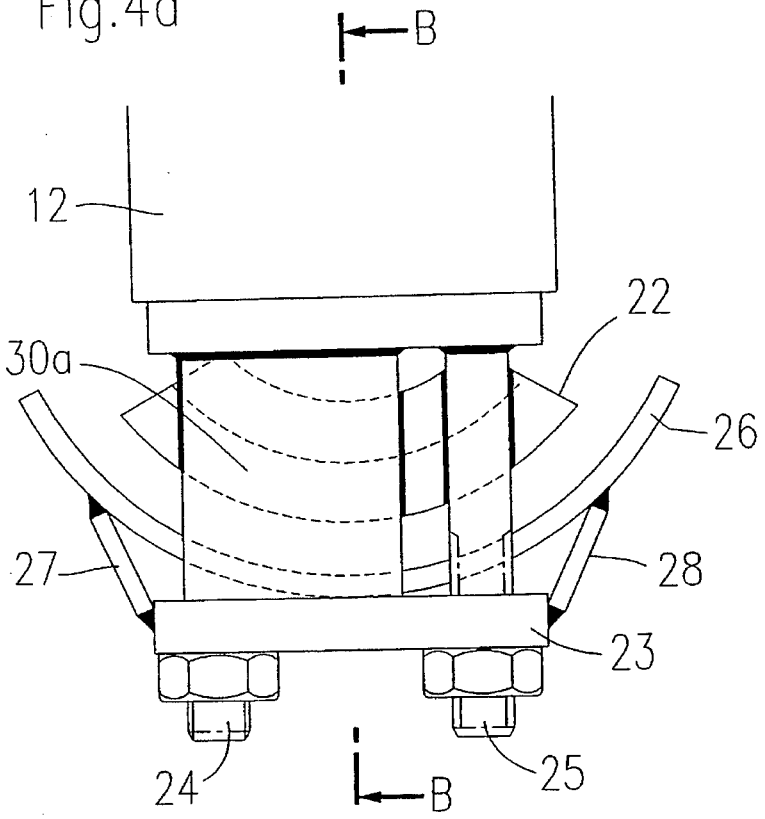
FIG. 4*a* shows substantially the same view as FIG. 4, but includes additional labelling of components.
Figure 5A:
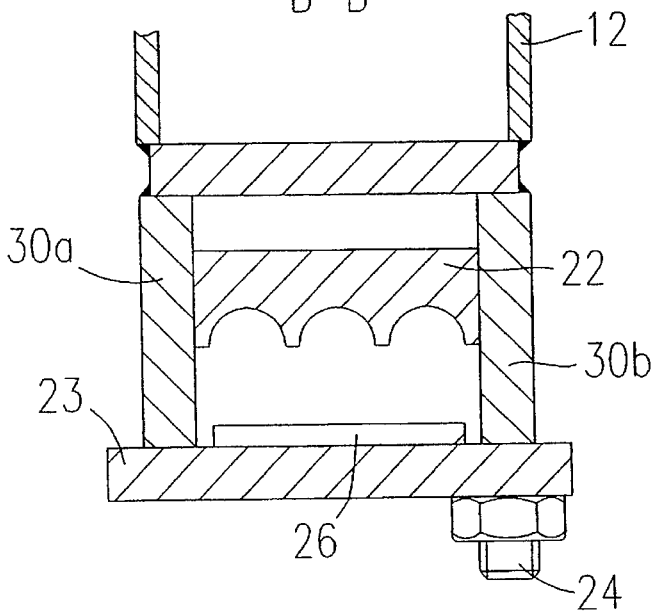
FIG. 5*a* shows a cross-section along the lines B—B in FIG. 4*a*, and shows substantially the same view as FIG. 5, but includes additional labelling of components.

In an alternative embodiment, two additional support plates 30*a* and 30*b*, shown in FIGS. 4*a* and 5*a*, can preferably be disposed between the annular cup 12 and the plate 23. The two additional support plates 30*a* and 30*b* can also assist in guiding the tension lines 29 through the part of the pulley 22.

In another alternative embodiment, the plate 23 may be fitted with a cone-shaped or pointed cup in order to allow the anchor body 11 to be driven into the soil easily. Alternatively, the plate 23 could be configured to have a cone-shaped or pointed surface itself.

As shown in FIG. 5, the grooves 22*a* can preferably be disposed adjacent one another, and the groves 22*a* may be configured to adapt to the types of lines 29, cables, or strands used. In addition, the number of tension lines 29 could possibly vary according to the load to be put on the anchor body 11. Therefore, the number of grooves 22*a* could also vary according to the number of tension lines 29 used or needed for the particular A sequence for the installation of the anchor will now be described.

The hose 19 can preferably be coupled to the block 15 and preferably three parallel steel ropes 29 can be inserted between their preferably bow-formed support or part of the pulley 22, and their preferably bow-formed protection plate 26. A conventional crawler drill rig with a rock drilling machine can advantageously be used to hammer down the anchor body 11, preferably with the end of the drill rod 17 inserted in the blind bore 16 of the block 15. The rotation of the drilling machine should of course be off. The anchor body 11 preferably pulls the hose 19 and the three steel ropes 29 with it as it is forced down into the soil. When the anchor body 11 has reached a competent layer, the drill rod 17, which is preferably a conventional extension rod, is preferably withdrawn. A grout-like material can then be injected into the anchor body 11, in order to inflate the anchor body 11. The steel ropes 29 are preferably then forced outwardly by the expansion of the anchor body 11. The deviation angle of the steel ropes 29 is thereby preferably reduced. The six ends of the steel ropes 29 can then preferably be coupled and tension loaded by the structure to be anchored almost immediately, since the steel ropes 29 will only apply compressive forces to the anchor body 11. The flats 14 will preferably be between the steel ropes 29 and the anchor body 11, which is advantageous, since the flats 14 preferably will distribute the load. It can be an advantage that the steel ropes 29 are not loaded until their angle of deviation has preferably been reduced, due to the inflation of the anchor body 11. The two ends of each steel rope 29 should preferably be equally tension loaded, in order to avoid slippage in the rope support or the part of the pulley 22 at the front end of the anchor body 11.

In an alternative embodiment, the flats 14 may be disposed centrally within the anchor body 11, as discussed previously.

Most anchors are used only temporarily, and it can be an advantage that the steel ropes 29 can be withdrawn after the anchor has been used. As can be seen in FIG. 3, simply by pulling one end of a steel rope 29, the steel rope 29 can be withdrawn from the anchor by sliding the steel rope 29 in its support or part of the pulley 22. For temporary anchors, it may be advantageous to use plastic-coated cables or strands to preferably allow for easier removal.

Figure 6:
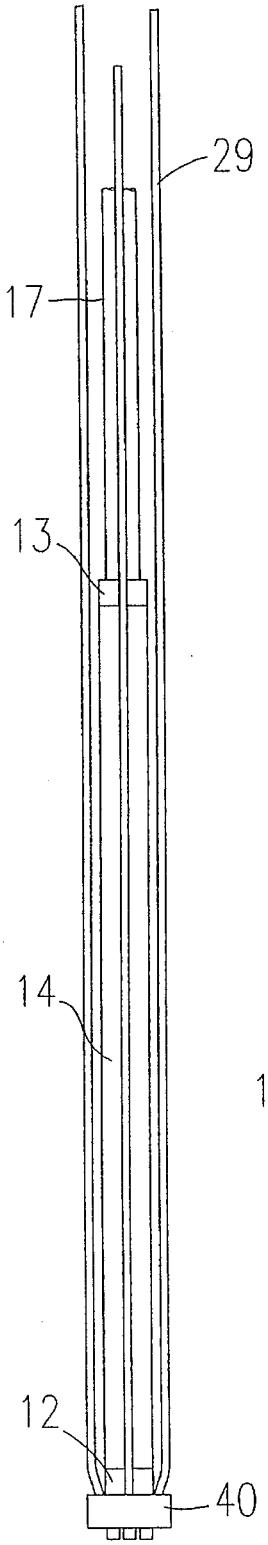
FIG. 6 shows an alternative cable arrangement for the anchor shown in FIGS. 1–4.
Figure 7:
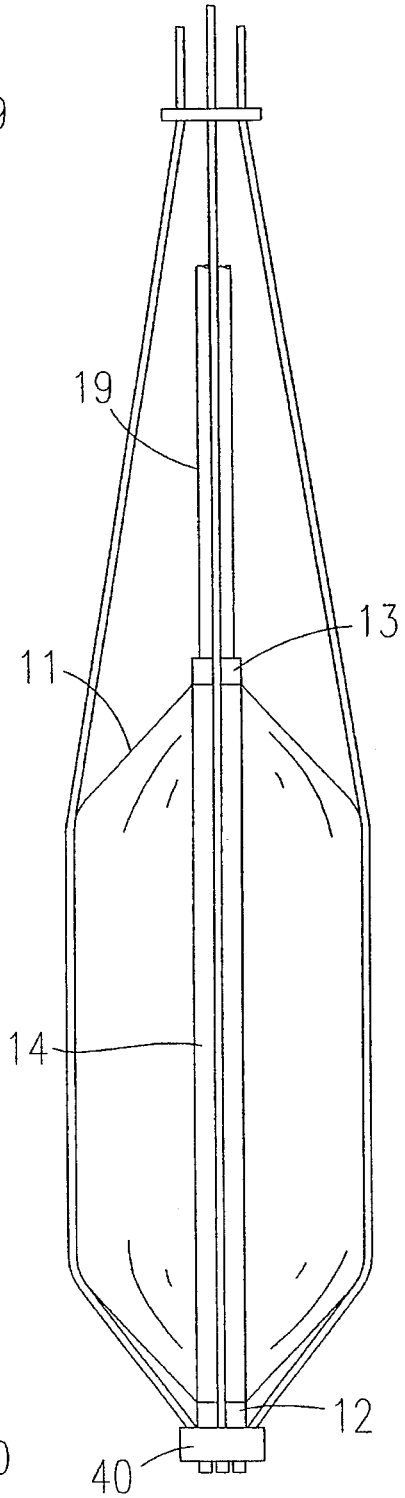
FIG. 7 shows the same anchor as shown in FIG. 6 with the anchor body in an expanded state.
Figure 8:
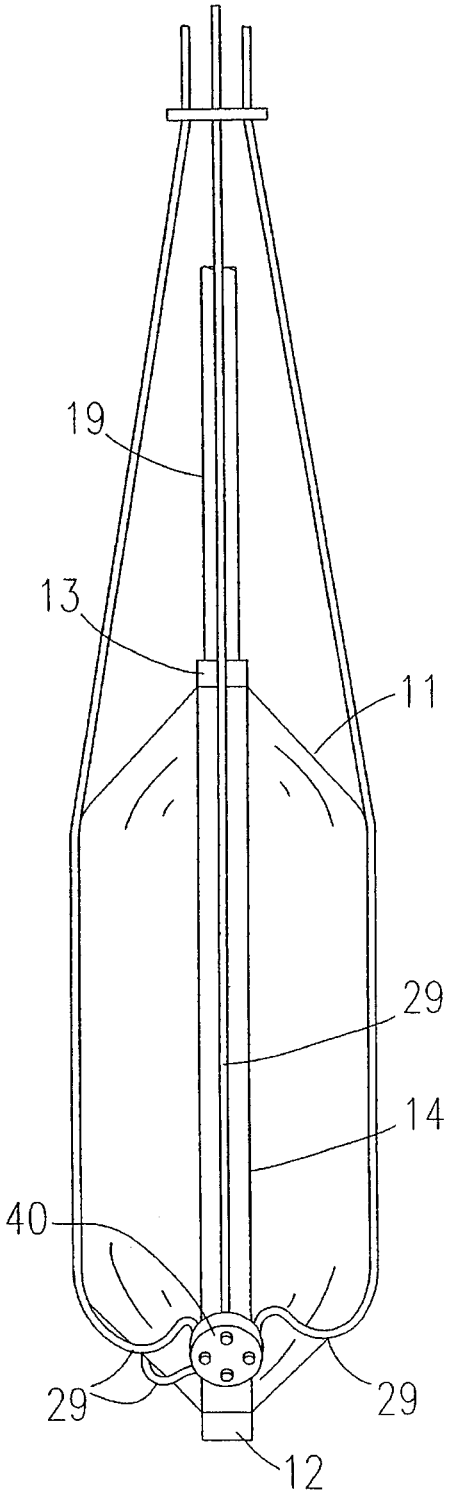
FIG. 8 shows the same anchor as shown in FIG. 6, but shows the anchor while being disassembled.

A modified steel rope arrangement is shown in FIGS. 6–8. As many as four preferably steel ropes 29 can be coupled to a yoke 40 at the front end of the anchor body 11. By pulling only one or two of the steel ropes 29, the yoke 40 will preferably detach from the anchor body 11, and the steel ropes 29 and the yoke 40 can preferably be pulled out of the soil. In this embodiment, the yoke 40 and the cup 12 can preferably be configured to permit the yoke 40 to slide off of the cup 12 when pulled by one or more steel ropes 29, as discussed above. The surfaces of the yoke 40 and the cup 12, which are preferably in contact with one another, may have curved edges. The curved edges would preferably permit the yoke 40 to easily detach from the cup 12. The yoke 40 and the cup 12 may also be configured in another way which would allow the yoke 40 to be easily removed from the front of the anchor. Alternatively, the yoke 40 could be attached directly to the front end of the anchor body 11, without the use of the cup 12, provided that the front end of the anchor body 11 were configured in a way to allow the yoke 40 to slide easily from the anchor body 11.

In the modified steel rope arrangement shown in FIGS. 6–8, the anchor could be assembled without the use of a steel block 15, and preferably only with one bore within the cup 13. In this embodiment, the cup 13 at the rear end of the anchor could be configured so that the cup 13 could receive force from a drill rod 17, hydraulic hammer, or other similar device, at or near the bore. Further, the cup 13 could also be configured to receive the hose 19 through the same bore.

In another alternative embodiment, the part of the pulley 22 arrangement could be configured to receive the tension lines 29 preferably at the rear end of the anchor body 11, possibly in the vicinity of the block 15. The rear end preferably being the end of the anchor body 11 which is closest to the surface after installation. In this embodiment, the tension lines 29 would preferably not be looped around the front end of the anchor body 11, as illustrated in FIGS. 1–8.

Figure 9:
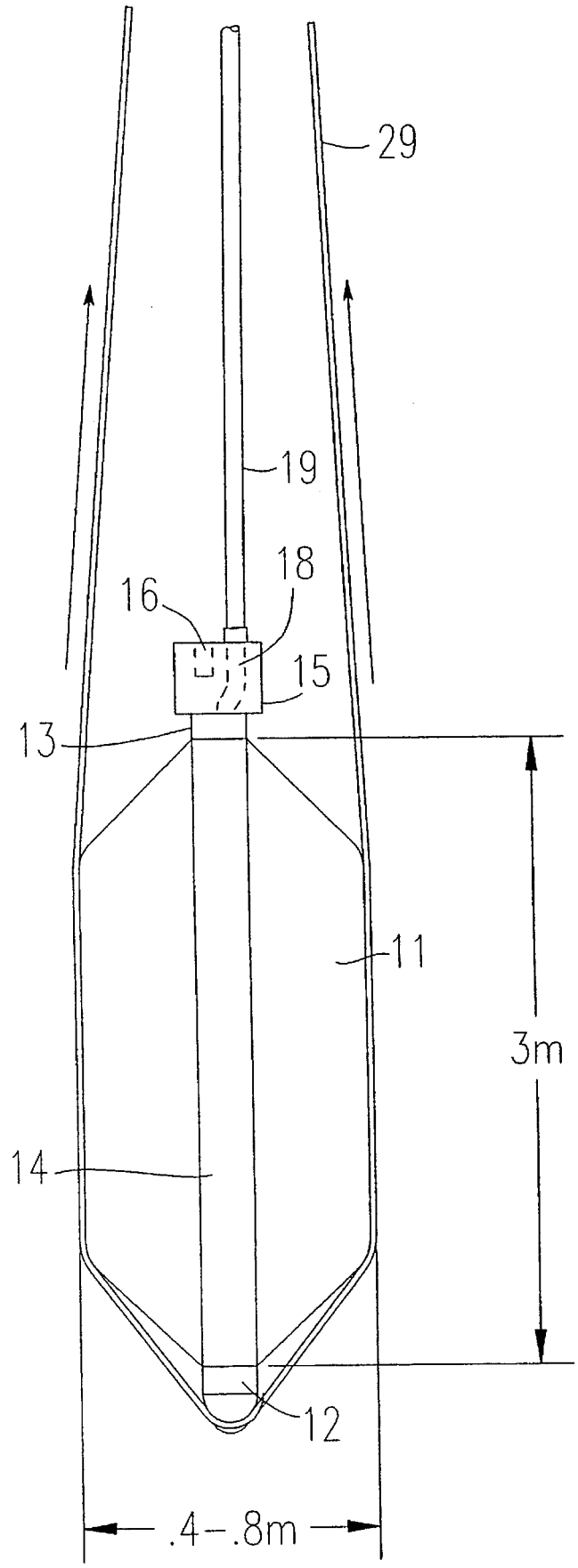
FIG. 9 shows various dimensions of the anchor body.

Some relative dimensions of the present invention are illustrated in FIG. 9. Typically, the anchor body 11 can be approximately 3 meters in length. The width of the anchor body 11, when in an unexpanded state, can be approximately 0.4 meters. The width of the anchor body 11, when in an expanded state, can be approximately 0.8 meters. The dimensions of the anchor body 11, however, are not to be limited to the above-mentioned dimensions. Anchors of different sizes may be manufactured to accommodate the type of structure to be anchored.

Figure 11:
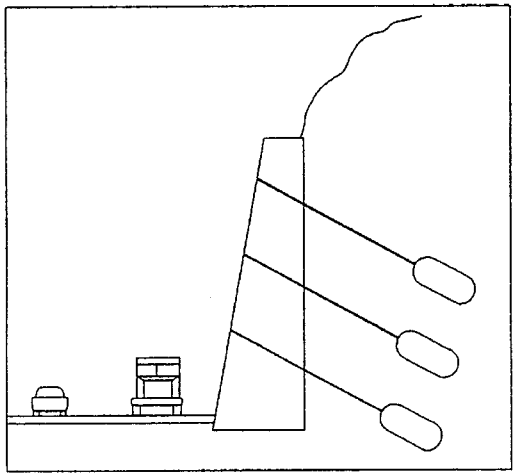
FIGS. 10–13 show an installed anchor body and various uses of an anchor body.
Figure 13:
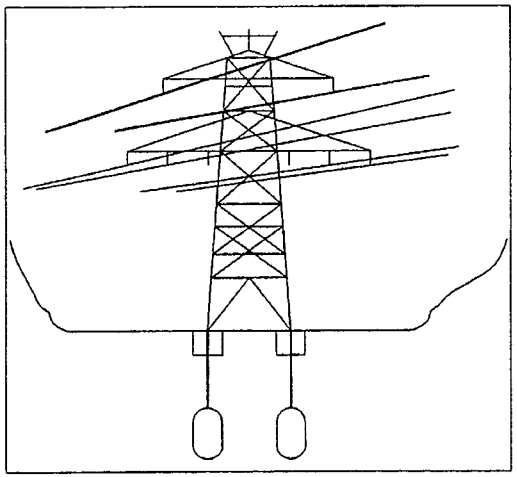
Figure 10:
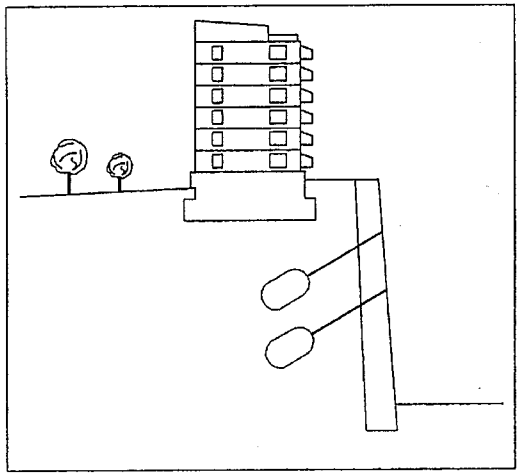
Figure 12:
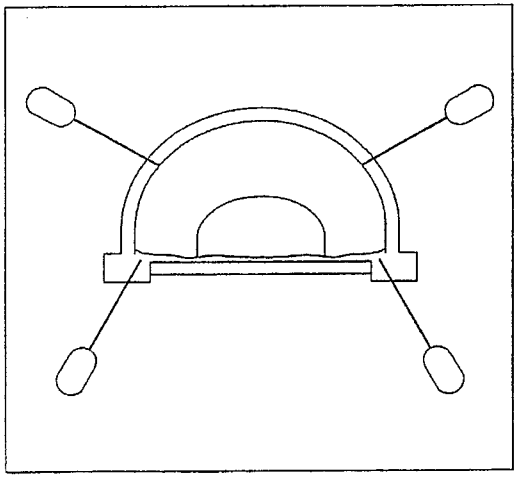

Some possible applications of the present invention are illustrated in FIGS. 10–13. The present invention may be used to anchor vertical structures. FIG. 10 shows an anchor in use with a retaining wall. FIG. 11 shows an anchor in use with a pylon. FIG. 13 shows an anchor in use with an electrical power line tower. The present invention may also be used to anchor tunnel structures, as shown in FIG. 12.

A possible advantage of the present invention over the anchors used in the past could be that the tension lines 29 can be looped around the front end of the anchor body 11, instead of being inserted into the anchor body 11. In the past, the tension lines 29 were preferably fed into the anchor body 11, either before or after pumping the hardenable material into the anchor body 11. Thus, the anchor was not useful until the material hardened around the tension lines 29. With the present invention, the tension lines 29 can preferably be threaded into the grooves 22*a*, preferably before hammering or forcing the anchor body 11 into the ground or soil. The tension lines 29 can then preferably be lead into the ground with the anchor body 11. The tension lines 29 can preferably be tensioned relatively quickly after the anchor body 11 is inflated.

Another possible advantage of the present invention can be that the expansible anchor body 11 preferably forms a predetermined shape. By knowing the eventual shape and relative dimensions of the anchor body 11 once inflated, accurate load calculations can be made. With anchors of the past, load calculations proved to be unreliable, because grout could disappear in unexpected directions. Thus, no precise information regarding load capacity could be calculated before tensioning the anchor. Further, the anchor body 11 of the present invention can be overinjected with grout or other hardenable material. The excess grout usually leaks out at the rear end of the anchor body 11 where the soil is preferably loosest. Thus, the excess grout may reinforce the loose soil, and the bearing capacity of the anchor body 11 can be increased.

One feature of the invention resides broadly in a method of installing a soil anchor by driving down an inflatable anchor body 11 of folded metal sheet into the ground by means of a rod and then pressurizing the body to develop the folds and expand the body, characterized by the steps of coupling a tension line 29 and a pressure hose 19 to the anchor body 11, so that the anchor body takes them with it into the ground, withdrawing the rod, expanding the anchor body by pressurizing it through the pressure hose 19, and tensioning the line.

Another feature of the invention resides broadly in a method, characterized by coupling the line 29 to the anchor body 11 outside of the body.

Still another feature of the invention resides broadly in a method, characterized by deviating the line 29 about the front end of the anchor body 11 to couple it to the anchor body so that there will be two ends of the tension line 29 above the ground.

Yet another feature of the invention resides broadly In a method, characterized by coupling two or more lines 29 in parallel to the anchor body 11.

Still yet another feature of the invention resides broadly in a method, characterized by mounting a bow-formed line support 22 on the front end of the anchor body 11 and deviating the line 29 about the support.

Yet still another feature of the invention resides broadly in a method, for installing a temporary soil anchor, characterized by the step of pulling one end of the line 29 to get the tension line 29 out of the ground when the anchor has been used.

Another feature of the invention resides broadly in a method, for installing a temporary soil anchor, characterized by coupling at least two tension lines 29 to a yoke 40 and mounting the yoke 40 on the front end of the anchor body 11 and pulling up the yoke 40 by pulling one of the lines to release the yoke 40 from the anchor body when the anchor has been used.

Still another feature of the invention resides broadly in a method, characterized by mounting three lines 29 to the yoke 40.

Yet another feature of the invention resides broadly in a method, characterized by hammering down the anchor body 11 by hammering on the rod 17 which is an extension rod, for example, a conventional rock drill extension rod.

Still yet another feature of the invention resides broadly in an inflatable soil anchor body 11 made of folded sheet metal that is sealed in both ends and has an inlet 18 for pressure fluid at its rear end, characterized by a bow-formed support 22 for a steel rope 29 at its front end, said support 22 permitting the rope to slide therein.

Types of expansible anchors are disclosed in the following patents: U.S. Pat. No. 5,085,546 to Fischer on Feb. 4, 1992, entitled "Mounting Assembly with an Expansible Anchor and a Mounting Tool"; U.S. Pat. No. 4,235,150 to Nony on Nov. 25, 1980, entitled "Expansible Anchor Plug"; U.S. Pat. No. 3,955,464 to Fischer on May 11, 1976,entitled "Expansible Anchor for Securing an Object to a Support Structure"; U.S. Pat. No. 3,958,488 to Fischer on May 5, 1976, entitled "Expansible Anchor"; U.S. Pat. No. 4,475,329 to Fischer on Oct. 9, 1984, entitled "Anchoring Expansible Fastener"; U.S. Pat. No. 4,536,115 to Helderman on Aug. 2, 1985, entitled "Anchor Apparatus for Insertion into a Preformed Hole".

Types of devices with which the present invention may be used are disclosed in the following patents: U.S. Pat. No. 4,993,501 to Zannini on Feb. 19, 1991, entitled "Hydraulic Hammer in Particular for Use in Dusty and/or Corrosive Environments"; U.S. Pat. No. 4,825,960 to Krone on May 2, 1989, entitled "Synchronized Hydraulic Hammer"; U.S. Pat. No. 5,265,688 to Rumpp et al. on Nov. 30, 1993, entitled "Rock Drill"; U.S. Pat. No. 5,064,005 to Krone on Nov. 12, 1991, entitled "Impact Hammer and Control Arrangement Therefor"; and U.S. Pat. No. 5,085,284 to Fu on Feb. 4, 1992, entitled "Hybrid Pneumatic Percussion Rock Drill".

The appended drawings in their entirety, including all dimensions, proportions and/or shapes in at least one embodiment of the invention, arc,accurate and to scale and are hereby included in this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein. Swedish Patent Application No. SE 9102054-5 and PCT/SE92/00508, filed on Jul. 1, 1991, and Jul. 1, 1992, respectively, and WO 93/01360 published on Jan. 21, 1993, having inventor Bo Torbjörn Skogberg, the corresponding Swedish Laid Open Patent Application, and corresponding Swedish Patent, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A soil anchor for anchoring a structure into soil, said soil anchor comprising:

an expandable anchor body configured for expanding and pressing against soil to wedge said soil anchor into soil;

a front end;

said front end comprising means for piercing and parting soil to permit said expandable anchor body to be driven into soil;

means for transmitting force from a location remote from said expandable anchor body to said expandable anchor body to drive said means for piercing and parting soil into soil;

said means for piercing and parting soil being connected to said expandable body to transport said expandable body into the soil;

means for transporting hardenable material from a location remote from said soil anchor into said expandable anchor body to expand said expandable anchor body and wedge said expandable anchor body into soil; and means for leading at least one cable, said means for leading being disposed at said front end, said means for leading at least one cable being configured for substantially preventing contact between at least one cable and the hardenable material while said hardenable material is hardening or hardened, and for permitting movement of at least one cable adjacent said expandable anchor body while said hardenable material is hardening or hardened.

2. The soil anchor according to claim 1 wherein said means for leading and permitting movement comprises means for leading at least one cable about said expandable anchor body while said hardenable material is hardening or hardened.

3. The soil anchor according to claim 2 wherein said means for leading and for permitting movement comprises:

a first support, said first support comprising:

at least one groove configured to receive and to guide at least one cable about said expandable anchor body.

4. The soil anchor according to claim 3 wherein said means for leading and for permitting movement further comprises means for protecting at least said first support, said means for protecting being disposed in a spaced apart relationship with said first support to provide a space therebetween and to permit movement of at least one cable between said first support and said means for protecting.

5. The soil anchor according to claim 4 wherein:

said soil anchor further comprises at least one cable disposed between said first support and said means for protecting;

said at least one cable extending from the remote location about said first support and back to said remote location; and said means for piercing and parting soil being operatively attached to said means for protecting.

6. The soil anchor according to claim 5 wherein:

said expandable anchor body has a first end disposed towards said front end of said soil anchor;

said soil anchor further comprises:

a cup disposed between said expandable anchor body and said first support, said cup being attached to said expandable anchor body and said first support; and said cup is configured to seal said first end of said expandable anchor body.

7. The soil anchor according to claim 6 wherein:

said means for piercing and parting soil comprises a plate having four sides disposed substantially perpendicular to one another;

said means for leading and for permitting movement comprises first and second side supports extending between said plate and said cup;

said first and second side supports are disposed on two opposite ones of said sides of said plate;

said first support and said means for protecting each comprise a semi-circular shape;

said means for protecting comprises a first and a second side disposed opposite one another;

said first side of said means for protecting faces said first support;

said second side of said means for protecting faces said plate;

said soil anchor further comprises:

a first support plate, said first support plate being attached to said second side of said means for protecting and being attached to said plate;

a second support plate, said second support plate being attached to said second side of said means for protecting and being attached to said plate;

said first support plate and said second support plate are disposed on two opposite ones of said sides of said plate;

at least two bolts disposed within said plate to attach said plate to said cup; said expandable anchor body further comprises:

a rear end disposed opposite to said first end;

a ring disposed annularly about said rear end of said anchor body;

means for connecting said ring and said cup to one another;

said means for connecting comprising metal plates;

means for receiving force operatively attached to said ring;

said means for receiving force comprising:

a first blind bore and a second bore;

said first blind bore being configured to receive said means for transmitting force;

said second bore extending into said anchor body and being configured to receive said means for transporting hardenable material;

said means for transmitting force comprises one of a rock drill with a drill rod and a hydraulic hammer;

said means for transporting hardenable material comprises a hose configured to receive pressurized hardenable material from the remote location and transport the hardenable material into said expandable anchor body;

said first support comprises three grooves configured to receive and to guide at least three cables about said expandable anchor body;

said expandable anchor body comprises folded metal sheets; and said soil anchor is configured to anchor structures such as retaining walls, pylons, electrical power line towers, and tunnel structures.

8. The soil anchor according to claim 2 wherein:

said means for leading and permitting movement comprises:

a yoke, said yoke being temporarily attached adjacent said front end;

said yoke being configured to detach from said front end when the at least one cable is pulled toward the remote location and away from said front end of said soil anchor; and means for attaching at least one cable to said yoke; said expandable anchor body comprises:

a first end disposed towards said front end of said soil anchor;

said soil anchor further comprises:

a cup disposed between said expandable anchor body and said yoke;

said cup being attached to said expandable anchor body and temporarily attached to said yoke; and said cup being configured to seal said first end of said expandable anchor body.

9. The soil anchor according to claim 8 wherein:

said soil anchor further comprises:

a rear end;

a ring disposed annularly about said anchor body at said rear end of said soil anchor;

means for connecting said ring and said cup to one another;

said ring comprising means for receiving force;

said means for receiving force comprising:

a bore;

said bore being configured to receive said means for transmitting force and said means for transporting hardenable material and to extend into said anchor body;

said means for transporting hardenable material comprises a hose configured to receive pressurized hardenable material from the remote location and transport the hardenable material into said expandable anchor body;

said means for transmitting force comprises one of a rock drill with a drill rod and a hydraulic hammer; said expandable anchor body comprises folded metal sheets; and said soil anchor is configured to anchor structures such as retaining walls, pylons, electrical power line towers, and tunnel structures.

10. A method of anchoring a structure into soil including a soil anchor, said method comprising the steps of:

connecting an expandable anchor body to means for piercing and parting soil to transport the expandable anchor body into soil;

leading at least one cable, with means for leading, about the expandable anchor body;

transmitting force from a location remote from the expandable anchor body to the expandable anchor body and driving the means for piercing and parting soil, the expandable anchor body, the means for leading at least one cable, and the at least one cable into soil;

transporting hardenable material from a location remote from the soil anchor into the expandable anchor body and expanding and wedging the expandable anchor body into soil;

preventing contact, with the means for leading, between the at least one cable and the hardenable material while the hardenable material is hardening or hardened;

moving, with the means for leading, the at least one cable about the expandable anchor body while the hardenable material is hardening or hardened;

operatively attaching the at least one cable to a structure to be anchored and tensioning the at least one cable between the structure and the expandable anchor body; and removing the at least one cable by pulling the at least one cable when the soil anchor is no longer needed.

11. A method of anchoring a structure into soil including a soil anchor, the soil anchor comprising: an expandable anchor body configured for expanding and pressing against soil to wedge the soil anchor into soil; a front end, the front end comprising means for piercing and parting soil to permit the expandable anchor body to be driven into soil; means for transmitting force from a location remote from the expandable anchor body to the expandable anchor body to drive the means for piercing and parting soil into soil; the means for piercing and parting soil being connected to the expandable body to transport the expandable body into soil; means for transporting hardenable material from a location remote from the soil anchor into the expandable anchor body to expand the expandable anchor body and wedge said expandable anchor body into soil; and means for leading at least one cable, the means for leading at least one cable being disposed at the front end, the means for leading at least one cable being configured for substantially preventing contact between at least one cable and the hardenable material while the hardenable material is hardening or hardened, and for permitting movement of at least one cable adjacent the expandable anchor body while the hardenable material is hardening or hardened; said method comprising the steps of:

providing an expandable anchor body configured for expanding and pressing against soil to wedge the soil anchor into soil;

providing a front end;

said step of providing of the front end comprises providing means for piercing and parting soil to permit the expandable anchor body to be driven into the soil;

providing means for transporting hardenable material from a location remote from the soil anchor into the expandable anchor body to expand the expandable anchor body and wedge the expandable anchor body into soil;

providing means for transmitting force from a location remote from the expandable anchor body to the expandable anchor body to drive the means for piercing and parting soil into soil;

providing means for leading at least one cable at the front end, the means for leading being configured for substantially preventing contact between the at least one cable and the hardenable material while the hardenable material is hardening or hardened, and the means for leading being configured for permitting movement of the at least one cable adjacent the expandable anchor body while the hardenable material is hardening or hardened;

said method further comprising the steps of:

connecting the means for piercing and parting soil to the expandable anchor body to transport the expandable anchor body into the soil;

leading the at least one cable adjacent the expandable anchor body with the means for leading;

transmitting force, with the means for transmitting force, from a location remote from the expandable anchor body to the expandable anchor body to drive the means for piercing and parting soil, the expandable anchor body, and the at least one cable into soil;

transporting hardenable material, with the means for transporting, from a location remote from the soil anchor into the expandable anchor body to expand the expandable anchor body and to wedge the expandable anchor body into soil;

moving the at least one cable adjacent the expandable anchor body while the hardenable material is hardening or hardened;

removing the at least one cable from the soil anchor by pulling the at least one cable away from expandable anchor body.

12. The method according to claim 11 wherein said step of providing the means for leading and permitting movement comprises providing means for leading the at least one cable about the expandable anchor body while the hardenable material is hardening or hardened; and leading the at least one cable about the expandable anchor body while the hardenable material is hardening or hardened with the means for leading at least one cable.

13. The method according to claim 12 wherein said step of providing the means for leading comprises:

providing a first support; and said step of providing the first support comprises:

providing at least one groove;

configuring the at least one groove to receive and to guide the at least one cable about the expandable anchor body; and receiving and guiding the at least one cable about the expandable anchor body with the at least one groove.

14. A method according to claim 13 wherein said step of providing the means for leading comprises:

providing means for protecting at least the first support;

disposing the means for protecting in a spaced apart relationship with the first support to provide a space therebetween and to permit movement of the at least one cable between the first support and the means for protecting;

said method further comprising the steps of:

disposing the at least one cable between the first support and the means for protecting;

extending at least one cable from the remote location about the first support and back to the remote location; and operatively attaching the means for piercing and parting soil to the means for protecting.

15. The method according to claim 14, further comprising the steps of:

providing the expandable anchor body with a first end;

disposing the first end towards the front end of the soil anchor;

providing a cup;

disposing the cup between and attaching the cup to the expandable anchor body and the first support; and configuring the cup to seal said first end of the expandable anchor body; and sealing the first end of the expandable anchor body with the cup.

16. The method according to claim 15, further comprising the steps of:

configuring the means for piercing and parting soil to comprise a plate having four sides disposed substantially perpendicular to one another;

configuring the means for leading to comprise first and second side supports;

extending the first and second side supports between the plate and the cup;

disposing the first and second side supports on two opposite ones of the sides of the plate;

configuring the first support and the means for protecting to each comprise a semi-circular shape;

configuring the means for protecting to comprise a first and a second side disposed opposite one another, the first side of the means for protecting facing the first support and the second side of the means for protecting facing the plate;

said method further comprises:

providing a first support plate and a second support plate;

attaching the first support plate to the second side of the means for protecting and attaching the first support plate to the plate;

operatively attaching the second support plate to the second side of the means for protecting and attaching the second support plate to the plate;

disposing the first support plate and the second support plate are disposed on two opposite ones of the sides of the plate;

providing at least two bolts;

disposing the at least two bolts within the plate to attach the plate to the cup;

said step of providing the expandable anchor body further comprises:

providing a rear end;

disposing the rear end opposite to the first end;

providing a ring;

disposing the ring annularly about the rear end of the anchor body;

providing means for connecting the ring and the cup to one another;

connecting the ring and the cup to one another with the means for connecting;

said step of providing the means for connecting comprises providing metal plates;

providing means for receiving force;

operatively attaching the means for receiving force to the ring;

said step of providing the means for receiving force comprises:

providing a first blind bore and a second bore;

configuring the first blind bore to receive the means for transmitting force;

configuring the second bore to receive the means for transporting hardenable material and to extend into the anchor body;

said step of providing the means for transmitting force comprises providing one of a rock drill with a drill rod and a hydraulic hammer;

said step of providing the means for transporting hardenable material comprises providing a hose;

configuring the hose to receive pressurized hardenable material from the remote location and transport the hardenable material into the expandable anchor body;

said step of providing the first support comprises providing three grooves;

configuring the three grooves to receive and to guide at least three cables about the expandable anchor body;

configuring the expandable anchor body to comprise folded metal sheets; and configuring the soil anchor to anchor structures such as retaining walls, pylons, electrical power line towers, and tunnel structures.

17. The method according to claim 12 wherein said step of providing the means for leading comprises:

providing a yoke;

temporarily attaching the yoke adjacent the front end;

configuring the yoke to detach from the front end when at least one cable is pulled toward the remote location, away from the front end of the soil anchor;

providing means for attaching at least one cable to the yoke;

attaching at least one cable to the yoke with the means for attaching;

said step of providing the expandable anchor body comprises providing a first end;

disposing the first end towards the front end of the soil anchor;

said method further comprises:

providing a cup;

disposing the cup between the expandable anchor body and the yoke;

attaching the cup to the expandable anchor body and attaching the cup temporarily to the yoke;

configuring the cup to seal the first end of the expandable anchor body; and sealing the first end of the expandable anchor body with the cup.

18. The method according to claim 17, further comprising the steps of:

providing the soil anchor with a rear end;

providing a ring;

disposing the ring annularly about the anchor body at the rear end of the soil anchor;

providing means for connecting the ring and the cup to one another;

connecting the ring and the cup to one another with the means for connecting;

said step of providing the ring comprises providing means for receiving force;

said step of providing the means for receiving force comprises:

providing a bore;

configuring the bore to receive the means for transmitting force and the means for transporting hardenable material and to extend into the anchor body;

said step of providing the means for transporting hardenable material comprises providing a hose;

configuring the hose to receive pressurized hardenable material from the remote location and transport the hardenable material into said expandable anchor body;

said step of providing the means for transmitting force comprises providing one of a rock drill with a drill rod and a hydraulic hammer;

configuring the expandable anchor body to comprise folded metal sheets; and configuring the soil anchor to anchor structures such as retaining walls, pylons, electrical power line towers, and tunnel structures.

* * * * *

UNITED STATES PATENT AND TRADEMARK OFFICE

CERTIFICATE OF CORRECTION

PATENT NO. : 5,465,535

DATED : November 14, 1995

INVENTOR(S) : Bo TORBJÖRN SKOGBERG

It is certified that error appears in the above-indentified patent and that said Letters Patent is hereby corrected as shown below:

In column 5, line 7, after 'welded', delete "d" and insert --to--.

In column 5, line 37, after 'particular' insert --job.--.

Signed and Sealed this

Seventeenth Day of December, 1996

*Attest:*

*Attesting Officer*

BRUCE LEHMAN

*Commissioner of Patents and Trademarks*